US005899039A

United States Patent [19]

Duff et al.

[11] Patent Number: 5,899,039

[45] Date of Patent: May 4, 1999

[54] METHOD FOR INSTALLING A SUSPENDED CEILING IN A STORAGE TANK

[75] Inventors: Michael P. Duff; David M. O'Meara, both of Joliet; Mark S. Kabala, West Chicago; Glenn E. Riley, Naperville; Robert G. Walter, Jr., Plainfield, all of Ill.

[73] Assignee: Chicago Bridge & Iron Company, Plainfield, Ill.

[21] Appl. No.: 09/012,633

[22] Filed: Jan. 23, 1998

[51] Int. Cl.[6] ..... E04B 2/28; E04B 9/20; E04H 7/00

[52] U.S. Cl. ..... 52/506.06; 52/122.1; 52/123.1; 52/125.1; 52/245; 52/745.01; 52/745.13; 52/745.2

[58] Field of Search ..... 52/122.1, 123.1, 52/125.1, 245, 506.06, 745.01, 745.13, 745.2

[56] References Cited

U.S. PATENT DOCUMENTS 3,352,443 11/1967 Sattelberg et al. ..... 220/560.12
3,788,015 1/1974 Musser ..... 52/245 X
3,906,700 9/1975 Fujiwara et al. ..... 52/745.2 X
4,006,567 2/1977 Flannery ..... 52/506.06 X

*Primary Examiner*—Christopher Kent
*Attorney, Agent, or Firm*—Marshall, O'Toole, Gerstein, Murray & Borun

[57] ABSTRACT

A method of providing a suspended ceiling in a storage tank involves building a deck on the floor of the storage tank and raising it into place by using an external hoist mechanism. The hoist mechanism is connected to the deck by cutting holes in the roof of the tank and feeding cables through the holes. The cables are attached to a series of extenders, such as metal bars, that are fixed to lift points on the deck. The extenders are long enough so that, once the ceiling is raised to its final position, portions of the extenders project into the holes in the roof. The ceiling is then fixed in position by securing the extenders to the roof. After the ceiling is secured in position, the holes in the roof are sealed.

20 Claims, 6 Drawing Sheets

METHOD FOR INSTALLING A SUSPENDED CEILING IN A STORAGE TANK

BACKGROUND OF THE INVENTION

This invention relates generally to outdoor industrial storage tanks. In particular, the invention relates to a method for installing a suspended ceiling in a storage tank such as those commonly used to store liquid materials at temperatures above or below ambient temperature. For example, liquefied gases such as methane, ethylene, propylene, propane, butane, and ammonia are commonly stored at temperatures below ambient temperature in flat-bottomed insulated storage tanks that operate at near atmospheric pressure. Such a storage tank must have adequate insulation on the roof of the tank, as well as on its bottom and shell.

Installing and maintaining insulation on the bottom and shell of a tank generally present no special problems. The tank bottom is generally flat and the shell is generally cylindrical with only one radius of curvature. Panels of insulation can be easily applied to such surfaces. Alternatively, Larsen, U.S. Pat. No. 3,991,842, describes a movable, vacuum-secured apparatus that can apply polyurethane insulating foam on the exterior surface of a shell and simultaneously cover the exterior surface with a metallic vapor barrier. As another alternative, Wissmiller, U.S. Pat. No. 3,147,878, describes a shell insulation that incorporates a second, outer shell that is spaced apart from the inner tank shell, establishing an insulating space between the two shells. A resilient blanket consisting, for example, of a material such as glass fibers is applied to the exterior surface of the inner shell while a free-flowing, lightweight, thermal insulation material consisting of a material such as expanded perlite is placed between the resilient blanket and the outer shell.

The more complicated shape of the roofs of most industrial storage tanks makes installation of roof insulation more difficult. The roof of such a storage tank may be conical, spherical, or ellipsoidal. Pre-assembled insulation panels for such shapes are difficult to fabricate and install. Because of these difficulties, special alternative insulating techniques have been developed. One common technique is to spray polyurethane foam directly on the exterior surface of the tank roof. Bellafiore et al., U.S. Pat. No. 4,333,973, describes one apparatus and method for spraying polymeric foamed-in-place insulation on horizontal and sloped surfaces such as tank roofs.

In addition to the installation problems, the exposure of roof insulation to ambient environmental conditions makes maintenance of roof insulation more troublesome. Rainwater and water vapor degrade the insulating effectiveness of externally-applied roof insulations. To delay such degradation, roof insulation for storage tanks is conventionally provided with a vapor barrier. However, the vapor barrier is exposed to the daily and annual changes in ambient temperature and solar insolation, as well as to rain, wind, ice, and snow, and generally deteriorates after a period of years. Deterioration of the vapor barrier can also result from thermal expansion and contraction of the tank, from personnel and equipment moving over the insulation surface, and from animal activity, all leading to degradation of the roof insulation.

Often, it is not possible or cost-effective to repair degraded roof insulation, and the insulation is instead entirely removed and replaced. This often requires that the tank be taken out of service for a period of time while the old insulation is removed and replaced.

Since the effective life of externally-applied tank roof insulation is relatively short, it has been found to be desirable to look for other types of roof insulation for insulated storage tanks.

Sattelberg et al., U.S. Pat. No. 3,352,443, describes an insulating ceiling that can be suspended from the inside surface of the roof of a storage tank. Because the metal tank roof protects the insulation carried by the suspended ceiling, such internal suspended ceilings have a significantly longer working life than externally-applied roof insulations. As a result, there would be a benefit in converting existing insulated storage tanks with externally-applied roof insulations into tanks with insulation supported by an internal suspended ceiling.

The Sattelberg et al. method of installing a suspended ceiling in an existing storage tank requires direct access to the underside of the tank roof in order to fasten the ceiling to the internal structural framework inside the tank roof. Unfortunately, since the roof is often 50 or more feet above the ground, this is not always easy or convenient, and externally-applied roof insulation remains in common use.

SUMMARY OF THE INVENTION

The applicants have developed an alternative method of providing a suspended ceiling in a storage tank that does not require access the underside of the roof. Instead, a deck that forms the base of the ceiling is built on the floor of the storage tank and raised into place by means of an external hoist mechanism. The hoist mechanism is connected to the desk by cutting holes in the roof of the tank and feeding cables through the holes.

The cables are attached to a series of extenders, such as metal bars, that are fixed to lift points on the deck. The extenders are long enough so that, once the ceiling is raised to its final position, portions of the extenders project into the holes in the roof. The ceiling is then fixed in position by securing the extenders to the roof. After the ceiling is secured in position, the cables are removed and the holes in the roof are sealed.

Because, unlike in conventional methods of installing a suspended ceiling in a storage tank, all roof work may be done from above the roof, there is no need for access to the underside of the roof. Accordingly, this construction method is useful both for new tank construction and for many types of retrofit applications in which insulation was previously applied to the top of a tank roof.

BRIEF DESCRIPTION OF THE DRAWINGS

Further advantages of the invention should be apparent to those skilled in the art upon reviewing the following detailed descriptions and accompanying drawings, in which.

DETAILED DESCRIPTION OF THE DRAWINGS

Figure 1:
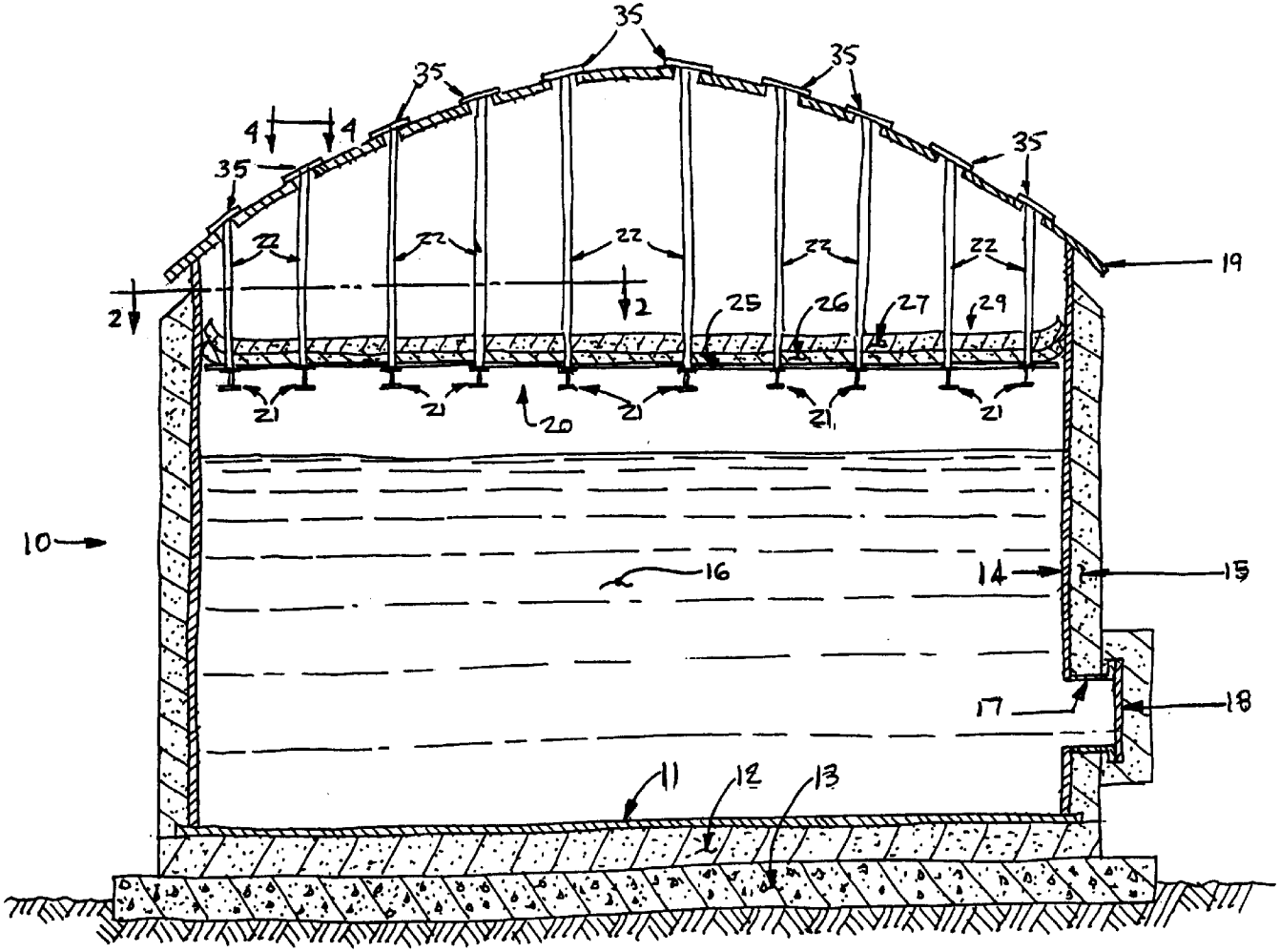
FIG. 1 is an elevational sectional view through an insulated storage tank in which a suspended insulating ceiling has been installed in accordance with the present invention.

FIG. 1 illustrates the general construction of a simple embodiment of an insulated storage tank 10 built in accordance with the present invention. The tank has a floor 11 that rests on bottom insulation 12. The bottom insulation is of a suitable thickness to limit heat transfer between the ground and the product 16 stored within the tank, and has sufficient structural load-bearing capacity to support both the tank and its contents. The bottom insulation rests on a supporting foundation 13, made, for example, of poured concrete.

The floor 11 is joined at its outer perimeter to a cylindrical tank shell 14, which is covered with shell insulation 15. The shell insulation is of a suitable thickness to limit heat transfer through the shell between the ambient environment and the stored product 16. The shell includes a manway 17 that can be used to provide access to the interior of the tank when it is not in normal service. The manway may be covered by a bolted manway cover 18 when product is being stored in the tank.

The shell 14 is joined at its top perimeter to a roof 19 that does not have any external insulation. Instead, internal insulation is borne on a deck 20 suspended within the tank.

Figure 2:
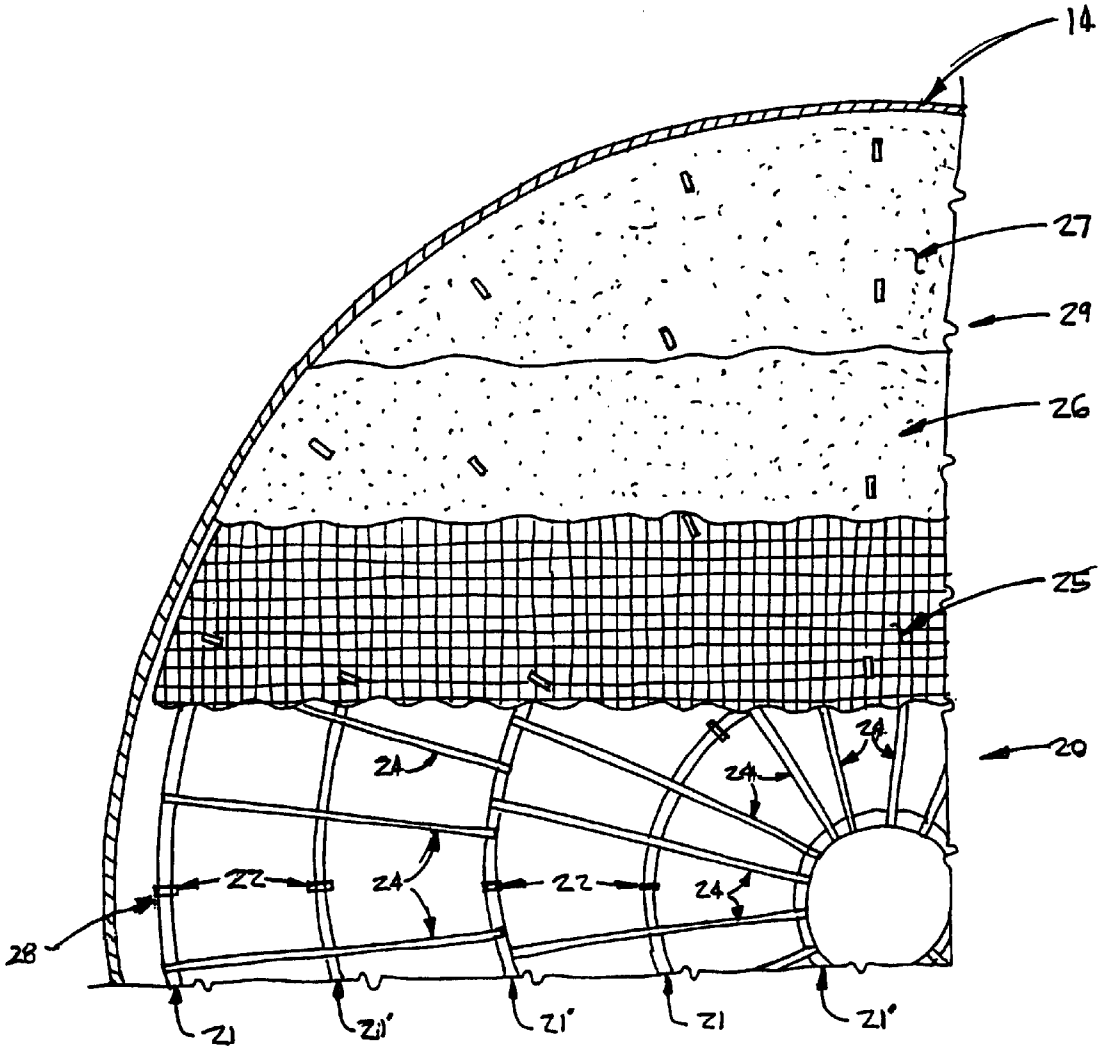
FIG. 2 is a partially-broken-away sectional view taken along line 2—2 in FIG. 1, showing the structural details of the suspended ceiling.

FIG. 2 illustrates the structural details of the deck 20. The deck is built on the floor 11 of the tank using materials brought into the tank through the manway 17. The illustrated deck includes a perimeter structure in the form of an outer ring girder 21 that corresponds in shape to the circular cylindrical shape of the shell 14 of the storage tank. (This girder may be brought through the manway in sections.) As illustrated, intersecting supports within the perimeter structure take the form of a series of concentric circular ring girders 21 joined together by radial bars 24.

The use of ring girders 21 makes it easier to identify points on the roof 19 of the tank where holes should be cut for raising the deck, a step that is described more fully below. The deck can alternatively be constructed with a rectangular framework of intersecting supports.

The ring girders 21 and radial bars 24 are covered with a support deck 25 to support the desired ceiling insulation 29. As illustrated, the support deck is fabricated of metal wire mesh, which may readily be brought into the storage tank in roll form through the manway 17. Other similarly strong, lightweight materials could also be used.

As illustrated, the ceiling insulation 29 consists of two layers 26, 27 of fiberglass blanket. The lower layer 26 may be provided with a solid bottom surface, such as an aluminum sheet or foil, to provide mechanical protection against fiberglass particles falling into the stored product 16. The upper layer 27 may have a similar solid top surface to provide mechanical protection against debris falling into the ceiling insulation. Preferably, the seams in the upper layer are located so as not to align with the seams in the lower layer.

A series of extenders, illustrated here in the form of structural bars 22, are attached to lift points 28 on the deck. The bars, which could be replaced by cables with terminal connection points or other suitable structural elements, may be attached to the lift points in any conventional way, such as be welding or bolting, but are preferably attached by pins.

Figure 3:
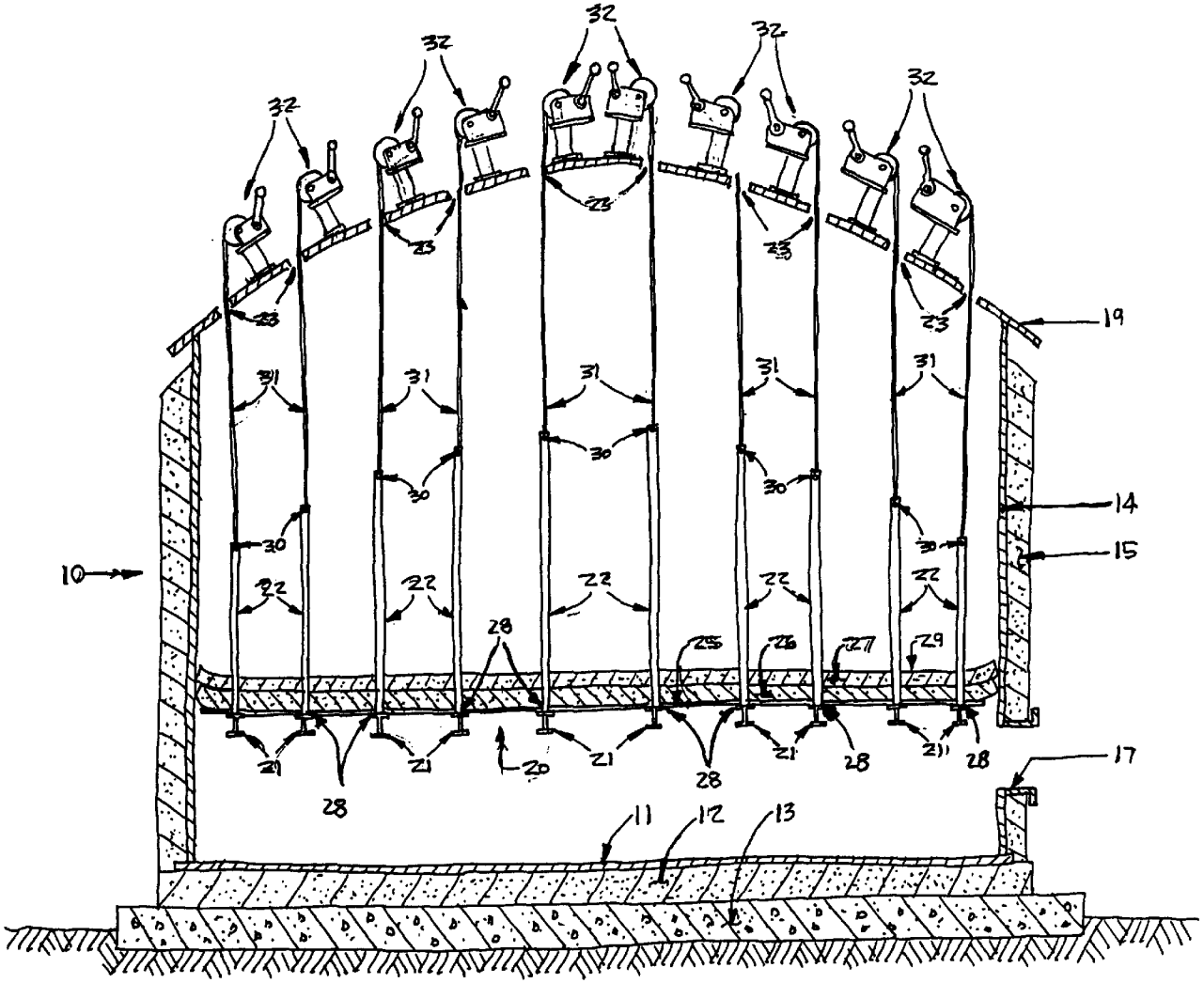
FIG. 3 is an elevational sectional view through an insulated storage tank that is in the process of being fitted with a suspended insulating ceiling.

FIG. 3 shows the deck 20 being raised from the floor of the tank. Relatively small holes 23 have been cut in the roof 19 of the tank above the lift points 28 on the deck. Because the illustrated lift points have been arranged in a polar pattern on the ring girders 21, it is relatively easy to identify appropriate locations for corresponding holes in the roof of the tank directly above the lift points. Hoist mechanisms 32 have been mounted on the exterior of the roof 19 next to the holes, and cables 31 have been unwound from the hoist mechanisms and lowered through the holes. The lower ends of the cables have been attached to cable attachments 30 on the bars 22, enabling the deck to be raised by activating the hoist mechanisms.

The lifting operation could of course vary significantly from the illustrated arrangement. As illustrated, it may be preferable if the hoist mechanisms 32 are controlled so the deck 20 is maintained in a horizontal plane while being raised. In other situations, it may be useful to raise certain portions of the deck before others are raised. Similarly, the roof holes 23 need not be directly above the lift points 28, and in some circumstances it may be preferable if they are offset. It is also not necessary that a separate hoist mechanism be used for each cable 31, or that the hoist mechanisms be mounted to the roof. For example, it sometimes may be useful to use pulleys or the like to connect all cables to a single hoist mechanism that is completely separate from the tank.

Preferably, the deck is raised to a final position at which the top of the upper insulation layer 27 is below the top edge of the shell 14. This helps to keep the temperature of the top of the shell close to ambient temperature, which may help to prevent excessive and potentially damaging temperature gradients through the joint between the shell and the roof 19. It is also preferable that the ceiling insulation 29 extend beyond the perimeter of the deck 20 into contact the inside surface of the shell, thus providing an insulating ceiling over all of the stored product 16.

To provide access to the ceiling insulation 29 after the deck 20 has been raised, it may be useful for the deck to include an outer girder 21 that has sufficient strength to support a lifting mechanism. For example, the illustrated outer girder is an I-beam with a vertical web. A lifting mechanism on a rolling trolley may be easily attached to this I-beam in a manner that permits the trolley wheels to roll on the top surface of the bottom flange of the I-beam. Once the deck is raised, the lifting mechanism on the trolley can be used to hoist installation personnel to inspect and adjust the outer edge of the ceiling insulation.

When the deck 20 is in the desired position, portions of the bars 22 project into the holes 23 in the roof 19 of the tank. The deck may be secured in position by fixing the bars within the holes by any appropriate means, some of which are described below. The cables 31 and hoist mechanisms 32 may then be removed, and the holes sealed.

Figure 4:
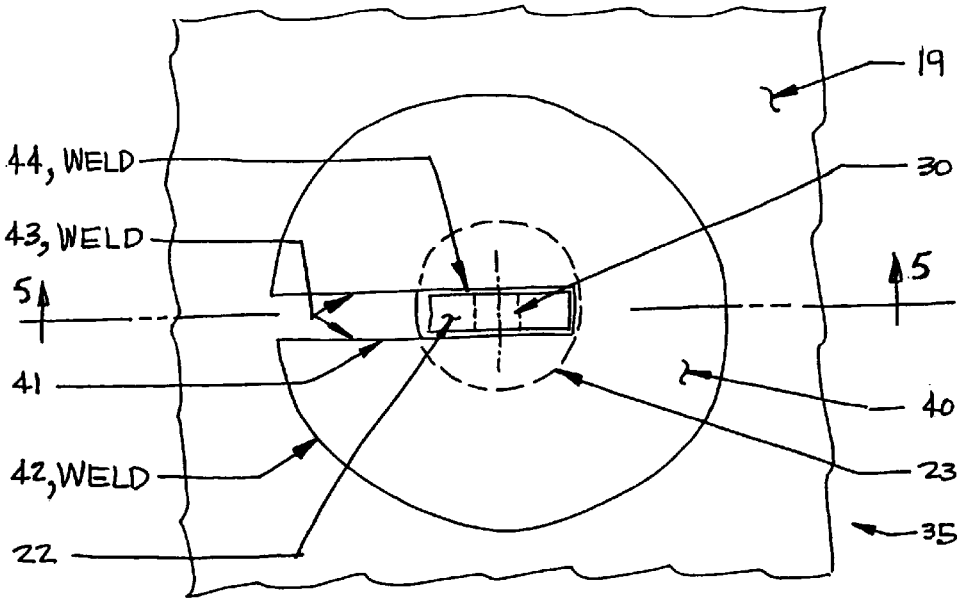
FIG. 4 is a plan view taken along line 4—4 of FIG. 1, showing one embodiment of an attachment device used to attach the suspended ceiling to the roof of the tank.

FIG. 4 shows one embodiment of a roof attachment device 35 that may be used for attaching a bar 22 to the roof 19. The device includes a support plate 40 having a radial slot 41 whose width is wider than the minimum dimension of the bar. The support plate is placed around the bar and rests on the top of the roof, covering the hole 23 in the roof.

Figure 5:
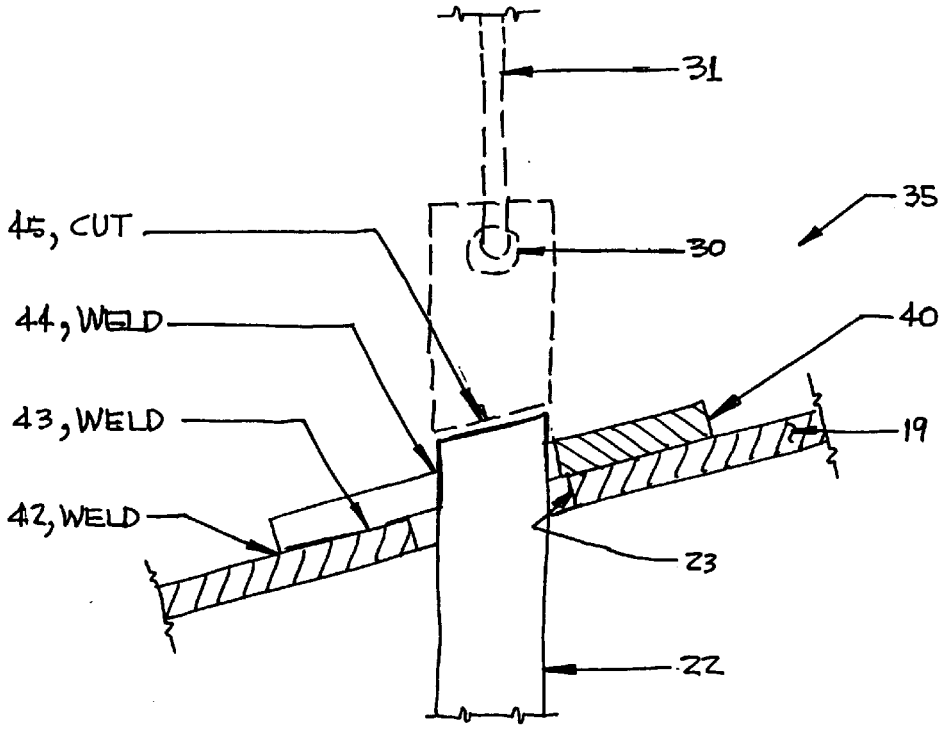
FIG. 5 is a vertical sectional view taken along line 5—5 of FIG. 4.

As seen in FIG. 5, a circular fillet weld 42 is used to join the support plate 40 to the top of the roof 19, and fillet welds 43 are used to join the inside edges of the slot 41 to the top of the roof. Another fillet weld 44 is used to join the bar 22 to the support plate, and extends around the entire perimeter of the bar. The combination of these fillet welds 42, 43, and 44 creates a vapor-tight attachment of the bar to the tank roof. After the fillet welds have been installed, the bar may be cut along line 45 to remove the uppermost portion of the bar.

Figure 6:
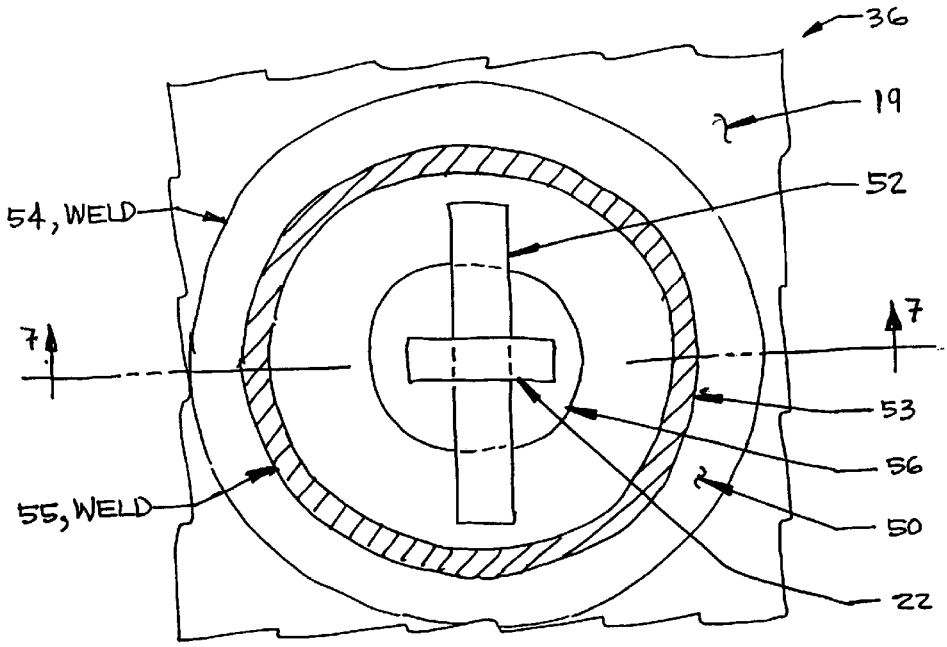
FIG. 6 is a plan view of a second embodiment of an attachment device.

FIG. 6 shows an alternative roof attachment device 36 that may be used for attaching the bar 22 to the roof 19 of the tank. This device includes a support plate 50 having an opening 56 that is of approximately the same width as the hole 23 in the roof, or that is otherwise sized to accommodate the bar. The support plate is placed on top of the roof so that the opening 56 in the support plate aligns with the hole in the roof. The bar 22 has a pin support 51 forming the top edge of a hole through which a pin 52 may be inserted. The pin support could alternatively be formed as, for example, a hook. The pin is longer than the width of the opening 56 in the support plate and, once engaged with the pin support, transmits the load carried by the bar to the tank roof through the support plate.

Figure 7:
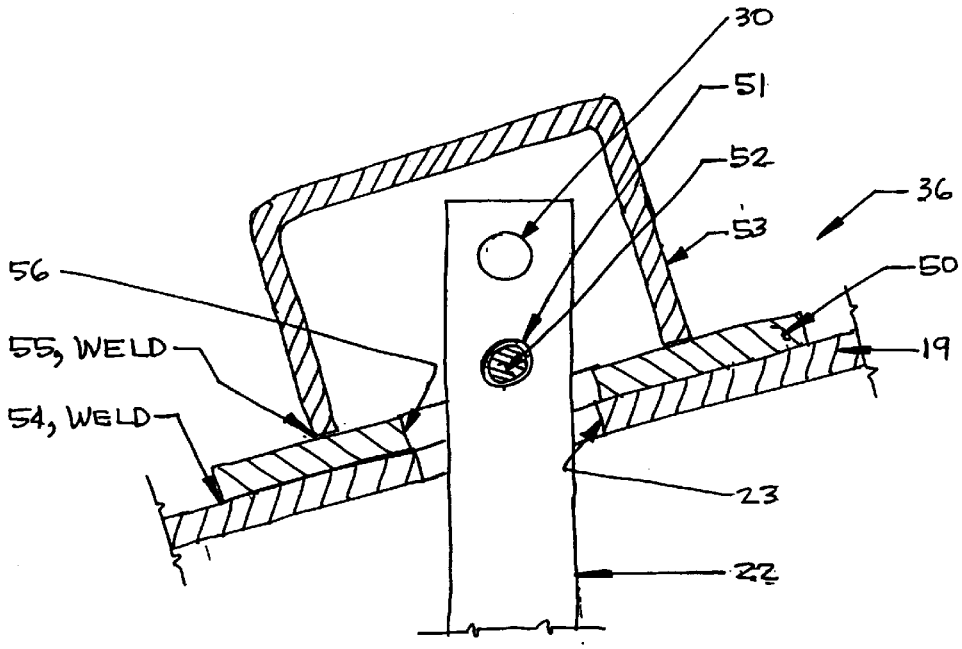
FIG. 7 is a vertical sectional view taken along line 7—7 of FIG. 6.

As seen in FIG. 7, a fillet weld 54 is used to join the support plate 50 to the top of the roof 19. After the load of the bar 22 is being transmitting to the tank roof (through the pin 52 and the support plate), the cable 31 is removed from the bar at the cable attachment 30. A suitable cover 53 is then be placed over the top of the bar and joined to the support plate with a fillet weld 55 to establish a vapor-tight attachment of the bar to the roof.

Figure 8:
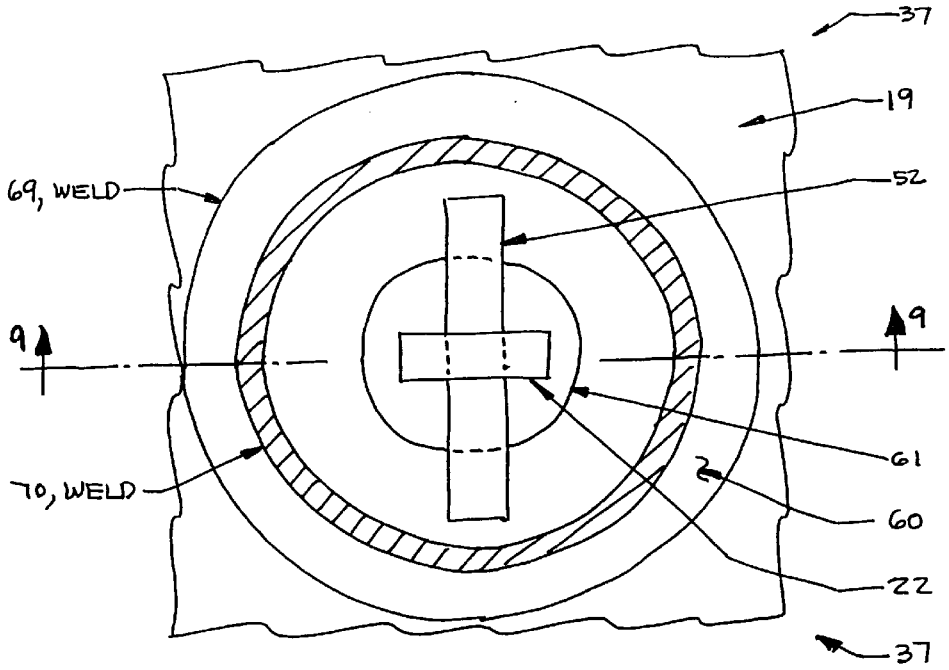
FIG. 8 is a plan view of a third embodiment of an attachment device.

FIG. 8 shows yet another possible attachment device 37 for attaching the bar 22 to the roof 19 of the tank. Like the previous embodiment, this device includes a support plate 60 having an opening 61 that is of approximately the same width as the hole 23 in the roof. The support plate is placed on top of the roof so that the opening 61 in the support plate aligns with the hole in the roof.

Figure 9:
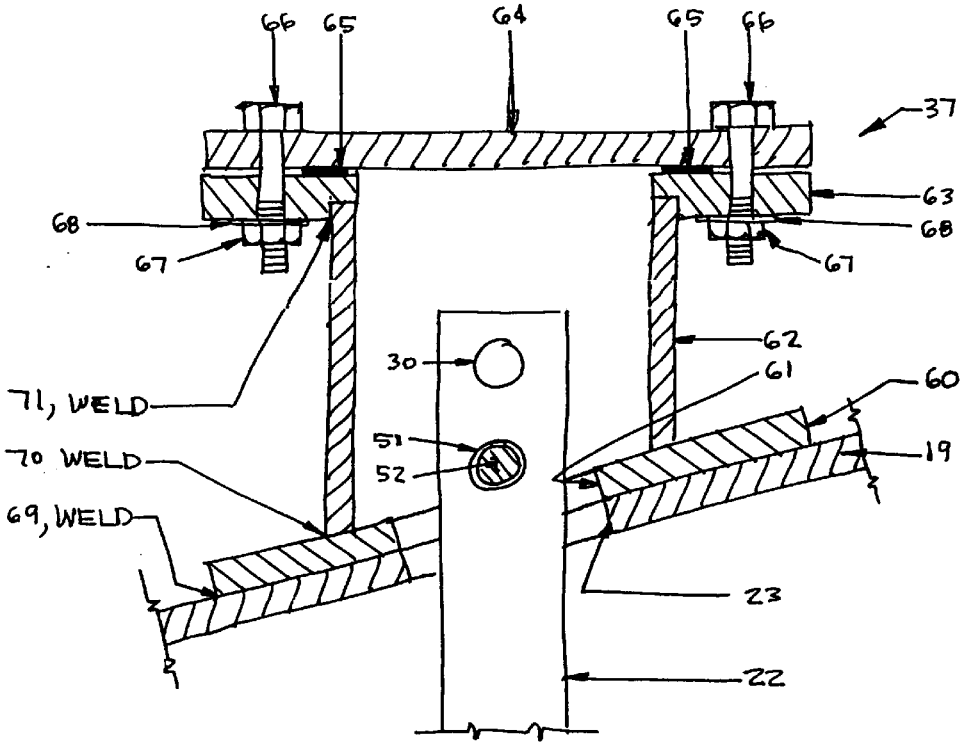
FIG. 9 is a vertical sectional view taken along line 9—9 of FIG. 8.

As seen in FIG. 9, a fillet weld 69 is used to join the support plate 60 to the roof 19. After the load of the bar 22 is being carried by the roof of the tank (through the pin 52 and the support plate), the cable 31 is removed from the bar and a cylindrical nozzle 62 is placed over the top of the bar and joined to the support plate 60 with a fillet weld 70. If not formed integrally with the nozzle, a flange 63 is joined to the top edge of the nozzle by a fillet weld 71. After a gasket 65 is placed on top of the flange, a cover 64 is placed over the gasket and joined to the flange by bolts 66, washers 68, and nuts 67 to establish a vapor-tight attachment of the bar to the tank roof.

This detailed description has been given only for clearness of understanding. As many modifications. will be obvious to those skilled in the art, no unnecessary limitations should be understood from this description. Instead, reference should be made to the following claims.

What is claimed is:

1. A method of installing a suspended ceiling in a roofed storage tank, the method comprising the steps of:

bringing ceiling materials into the storage tank through a manway;

using the ceiling materials to build a deck on the floor of the storage tank, the deck including intersecting supports within a perimeter structure that corresponds in shape to the shape of the storage tank;

attaching a series of extenders to lift points on the deck;

cutting holes in the roof of the storage tank, passing cables through the holes, and connecting the cables to the extenders and to a hoist mechanism outside the storage tank;

using the hoist mechanism to raise the deck to a position in which portions of the extenders project into the holes in the roof of the tank;

securing the extenders to the roof; and sealing the holes in the roof.

2. A method as recited in claim 1, in which the intersecting supports comprise ring members.

3. A method as recited in claim 1, in which the deck further comprises a support for a lifting mechanism.

4. A method as recited in claim 1, in which the extenders comprise a series of bars.

5. A method as recited in claim 1, in which the extenders comprise bars that are connected to the deck by pins.

6. A method as recited in claim 1, in which insulation is placed above the deck.

7. A method as recited in claim 1, in which insulation is installed radially outwardly of the perimeter of the deck to contact a side of the storage tank.

8. A method as recited in claim 1, in which the deck further comprises a support deck positioned above the intersecting supports.

9. A method as recited in claim 1, in which the deck further comprises a support deck made of wire mesh.

10. A method as recited in claim 1, in which an attachment device is attached to the exterior of the roof adjacent one of the holes.

11. A method as recited in claim 1, in which a support plate with a slot sized to accommodate one of the extenders is attached to the roof adjacent one of the holes.

12. A method as recited in claim 1, in which;

at least one of the extenders comprises a pin support; and the extender is secured in position by engaging a pin with the pin support.

13. A method as recited in claim 1, in which at least one of the holes is sealed by a cover that passes over an upper end of the extender projecting into said at least one hole.

14. A method as recited in claim 1, in which an end of at least one of the extenders is removed after the extender is secured in position.

15. A method as recited in claim 1, in which insulation comprising a rigid top surface and a rigid bottom surface is placed upon the deck.

16. A method as recited in claim 1, in which the hoist mechanism is secured to the roof of the storage tank for lifting the deck, and is removed after the extenders are secured in position.

17. An insulated suspended ceiling made by the method of claim 1.

18. A suspended ceiling made by the method of claim 1, in which the intersecting supports comprise ring members.

19. A suspended ceiling made by the method of claim 1, in which the deck further comprises a support for a lifting mechanism.

20. A suspended ceiling made by the method of claim 1, in which the extenders comprise a series of bars.

* * * * *